US006249223B1

(12) United States Patent
Christensen

(10) Patent No.: US 6,249,223 B1
(45) Date of Patent: Jun. 19, 2001

(54) MODULAR ALARM SYSTEM

(76) Inventor: Dean Everett Christensen, 216 Marin St., Apt. 204, San Rafael, CA (US) 94901

( * ) Notice: Subject to any disclaimer, the term of this patent is extended or adjusted under 35 U.S.C. 154(b) by 0 days.

(21) Appl. No.: 09/495,074

(22) Filed: Jan. 31, 2000

(51) Int. Cl.[7] ..... G08B 21/00
(52) U.S. Cl. ..... 340/540; 340/538
(58) Field of Search ..... 340/540, 539, 340/527, 538, 524, 541, 310.02, 310.03, 310.08; 307/31, 40

(56) References Cited

U.S. PATENT DOCUMENTS 3,818,466 * 6/1974 Honda ..... 340/216
3,922,664 * 11/1975 Wadsworth ..... 340/310 A
4,410,883 * 10/1983 Swiston, Sr. ..... 340/538
4,755,792 * 7/1988 Pezzolo et al. ..... 340/538
5,705,979 * 1/1998 Fierro et al. ..... 340/538
5,714,933 * 2/1998 Le Van Suu ..... 340/538

* cited by examiner

*Primary Examiner*—Daniel J. Wu
*Assistant Examiner*—John Tweel, Jr.
(74) *Attorney, Agent, or Firm*—Risro A. Rinne, Jr.

(57) ABSTRACT

A modular system for providing security to an office or residence is provided that includes a plurality of modular components that each connect to a common AC electrical power supply line and communicate digitally with each other by supplying and decoding a digitally encoded message via a carrier signal that is modulated over the AC line. At a minimum, a control panel and at least one sensor are required. A signaling device provides indication of an emergency situation. Easy installation is provided by installing each of the modular components and by powering the control panel lastly which, upon power-up, polls every possible digital address to determine which modular components are connected. Optional telephone connections to a central monitoring site are also provided as well as remote control of the system over the telephone line by the monitoring site or by the user.

13 Claims, 4 Drawing Sheets

MODULAR ALARM SYSTEM

BACKGROUND OF THE INVENTION

1. Field of the Invention

The present invention, in general relates to alarm systems and, more particularly, to modular alarm systems having component parts that derive their power and communicate to each other via the electrical supply line.

A great variety of alarm systems are known. Certain of these types of alarms systems include various types of sensors that are connected to a central processor, and as such are more sophisticated types of devices. They usually are expandable but, being hard-wired to a particular location, they are not easily portable for use at new locations.

Other types of alarm systems are stand-alone systems and tend to be more simple, not having any component parts connected thereto. Being simple, they are often portable and easy to install. One example of such a device is hung from the inside of a door handle and sounds an alarm if the door is opened. As such, the more simple alarm systems are useful for those who are apt to move their alarm systems frequently from place to place, such as from hotel room to hotel room.

However, being simple devices, they tend not to be adaptable to the security requirements of different or more permanent places. For example, they may not be expandable and so are unable to include additional types of sensors, such as those, for example, that could detect unauthorized entry through a window. In general, simple alarm systems are considerably more portable than the presently known types of more sophisticated alarm systems.

Conversely, more elaborate types of alarm systems may, for example, include additional capabilities, such as being able to communicate with a central monitoring station in addition to accepting a variety of sensors, etcetera.

However, all sophisticated systems tend to share one disadvantage in that they require considerable labor to install in either a residence or in a commercial location. It is the high cost of labor, more than any other single factor, that drives up the cost of installing an alarm system.

This is a significant impediment that many alarm companies must first overcome. Many commercial alarm companies provide monitoring services at a monthly premium. If they can install an alarm system at a particular residence, then they are likely to reap the monthly rental returns that will follow each installation for a considerable period of time.

However, if the initial cost to install the alarm system is too high, this will deter sales and therefore monthly rental amounts will not be maximized. In other words, it is advantageous for those alarms companies that provide a monitoring service to offer a low installation cost to their prospective customers.

Some monitoring companies, therefore, discount the initial cost of equipment if the customer will enter into a long term contractual agreement that would include the alarm company providing a monthly monitoring service. Entering into a long term contract, especially a high-priced long term contract, is by itself a deterrent for some people and so sales of alarm systems remain limited.

Some of the discounts necessary to persuade a prospect to accomplish an installation may even result in an initial financial risk and therefore a possible loss to the alarm system company. If an alarm system is installed by an alarm company at a price that is below their cost and the customer immediately violates his or her contract, the alarm system company loses money.

It is, therefore, desirable to be able to offer an alarm system that greatly reduces the cost of installation and, as mentioned hereinabove, a significant portion of the cost of installation is due to the high cost of the labor that is required to install the alarm system. Therefore, an alarm system that reduces the cost of installation is an especially valuable product.

Another disadvantage that most current sophisticated alarm systems share is that they affect the building that they are installed in. For example, they require electrical connections and mechanical attachment to the structure that precludes their current installation as well as their subsequent removal, should that someday be desired.

The need to install an alarm system without significantly affecting the surrounding structures occurs, for example, in all rental situations. Commercial rental needs appertain often to office and business space while residential needs may include rented homes, cabins, and apartments, just to name a few examples of each.

In these types of more permanent locations it is often not possible to install a more sophisticated type of an alarm system without also installing added wiring in or through the walls and by physically attaching sensors to the structure. Such an installation may then be viewed as being more permanent in nature. As a result, such an installation may violate the prevailing lease agreements if done without first obtaining prior written permission. If it is installed, such an alarm system may then be regarded as a "permanent" installation and so become the property of the property owner.

The possibility of installing an alarm system and then, as a result, offending the property owner is a deterrent that precludes many alarm system installations.

The added possibility of investing heavily in an alarm system and then losing ownership of that system is an especially powerful deterrent.

In addition to the above disadvantages of current types of systems, new sensors are continually being developed that rely upon all manner of detection technologies. Some of these sensors detect or respond to either fire, smoke, carbon monoxide, intrusion, infrared detection, pressure changes, motion, and the like.

It is, therefore, also desirable to be able to incorporate advances in sensor development as they occur into an alarm system. Ideally, such a system would be expandable as desired and new types of sensors could be added as desired, where desired, and when desired. From a preceding example discussed hereinabove, it may be deemed desirable to be able to add a new type of a sensor to better detect unauthorized entry through a window and to connect that new type of a sensor to the alarm system.

Such an alarm system would be a "modular" system in that different modules, some of them being "sensor modules" of new and more advanced technology could be added, as desired.

Changing needs also warrant changes in an alarm system. Additions are often added to homes and adjoining office space may be adjudicated to existing offices thereby expanding security needs. A flexible modular alarm system is therefore desirable that can accommodate such types of changes.

There is also a need to be able to tailor the sophistication of the alarm system to suit individual requirements. For example, in a low crime area a resident may only desire a basic system with perhaps one or two infrared motion detectors (sensors). In the same neighborhood, a disabled resident may desire a similar system, but with a telephone link to a central monitoring station to provide enhanced crisis assistance.

In another neighborhood with a higher incidence of crime, additional sensors may be required or the services of a central monitoring station may be more urgently needed. The same motives encouraging the use of a more sophisticated type of an alarm system would likely also apply to a residence even if the residence is located in what is generally regarded as a "safe area" if that residence contains especially valuable items. Easily liquidated items, such as firearms or jewelry, being frequent candidates for theft will exemplify such security requirements.

Depending upon the crime history and also the reliability of electrical service in a given area, the need for battery backup may also arise.

Similar considerations apply to the protection of office space. The contents, location, and crime history of the area are all factors that affect and influence the appropriate type of a security (alarm) system that is required to optimally protect the office.

For all of these and other considerations as well, it is desirable to be able to tailor the type of an alarm system to satisfy the particular circumstance and yet maintain ease of installation. Furthermore, it is desirable to be able to install such a system, regardless of its sophistication, without substantially affecting the surrounding structures.

Accordingly, there exists today a need for a modular alarm system that is easy to install, which does not substantially and permanently affect the surrounding and supporting structures, and which is also easy to remove. Furthermore, there is a need for a modular alarm system that can be upgraded and expanded to satisfy changing security needs or when new and improved sensors or other types of component parts become available.

Clearly, such a system would be useful and especially desirable.

2. Description of Prior Art

Alarm systems are, in general, known. For example, the following patents describe various types of these devices:

U.S. Pat. No. 3,818,466 to Honda, that issued on Jun. 18, 1974;

U.S. Pat. No. 3,922,664 to Wadsworth, Nov. 25, 1975;

U.S. Pat. No. 3,925,763 to Wadhwani et al. Dec. 9, 1975;

U.S. Pat. No. 4,203,096 to Farley et al, May 13, 1980;

U.S. Pat. No. 4,290,056 to Chow, Sep. 15, 1981;

U.S. Pat. No. 4,385,287 to Eatwell, May 24th, 1983;

U.S. Pat. No. 4,567,557 to Burns, Jan. 28, 1986;

U.S. Pat. No. 4,660,023 to Thern et al., Apr. 21, 1987;

U.S. Pat. No. 4,755,792 to Pezzolo et al., Jul. 5, 1988;

U.S. Pat. No. 5,714,933 to Le Van Suu, Feb. 3, 1998; and

U.S. Pat. No. 5,757,672 to Heopken, May 26, 1998.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices. The teachings of the above cited prior art patents are incorporated herein by reference.

OBJECTS AND SUMMARY OF THE INVENTION

It is an object of the present invention to provide a modular alarm system that is easy to install.

It is also an important object of the invention to provide a modular alarm system that reduces the cost of labor to install.

Another object of the invention is to provide a modular alarm system that can be expanded.

Still another object of the invention is to provide a modular alarm system that is portable.

Still yet another object of the invention is to provide a modular alarm system that does not substantially affect the surrounding structure in which it is used.

Yet another important object of the invention is to provide a modular alarm system that can be upgraded with new technology components, as they become available.

Still yet another important object of the invention is to provide a modular alarm system that reduces the cost of installation.

Still yet one other important object of the invention is to provide a modular alarm system that utilizes the existing AC wiring of a building for communication between components parts thereof.

Another important object of the invention is to provide a modular alarm system that polls to determine all possible devices that are (or can be) connected to it and notes their presence and status.

Briefly, a modular alarm system that apparatus for use in residential and commercial security applications that is constructed in accordance with the principles of the present invention has a control panel and at least one sensor connected to a source of alternating voltage electrical power, such as a 120 VAC line. Bi-directional digital communication occurs over the AC line between the control panel and the sensor when an emergency condition, such as an unauthorized entry is detected, and also when the system is initially installed and powered up. On installation, the control panel outputs every possible address and notes all devices (i.e., sensors and like devices) that respond. If other devices are later added the control panel repeats the polling sequence thereby detecting the presence of the newly added device. Each sensor or device can include battery backup. An optional telephone connection to the control panel allows for remote control of the system or connection to and monitoring by a remote monitoring site (service).

DETAILED DESCRIPTION OF THE INVENTION

Figure 1:
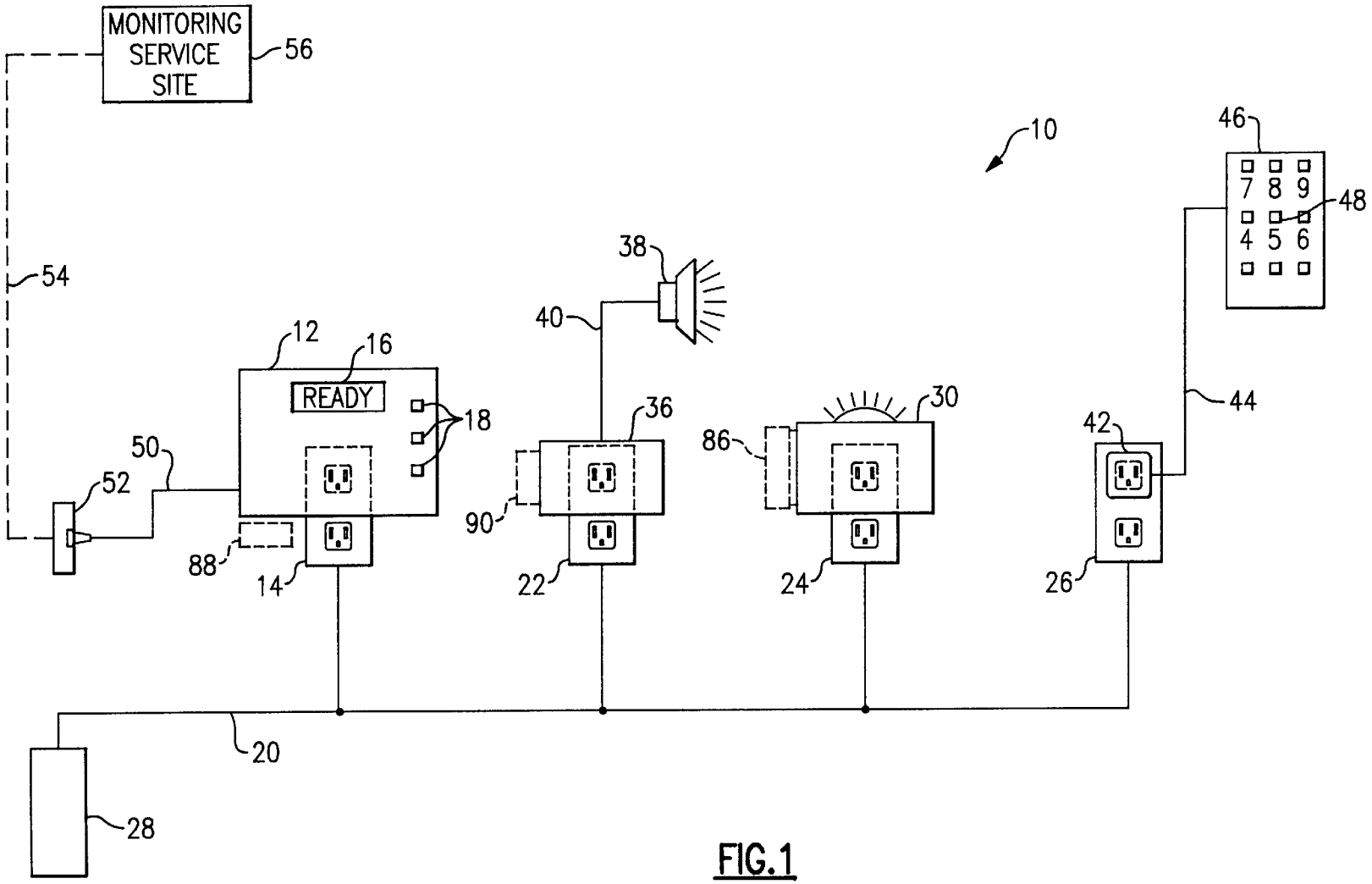
FIG. 1 is a block diagrammatic view of a modular alarm system.

Referring to FIG. 1 is shown, a modular alarm system, identified in general by the reference numeral 10 and hereinafter referred to as "the system 10".

The system 10 is installed in any commercial or residential type of a structure that includes electrical AC wiring, such as the type that typically carries a 120 VAC 60 cycle source of electrical power. As is well known in the electrical power arts, this type of a 120 VAC wiring system is commonly included in virtually all types of structures that are built in the United States of America where the wiring system is often partially disposed in the walls and floors of these structures when they are either built or remodeled.

Other countries may rely upon an AC electrical supply having a different voltage or frequency (or both) than that of the United States. The system 10 is adaptable for use in those countries as well by simply modifying the component parts thereof, which are described in greater detail hereinafter, so as to cooperate with the particular source of AC power that is being supplied while continuing to function as described herein. The benefits provided by the system 10 remain the same providing there is a source of alternating current and voltage present.

It is the fact that an electrical power supply wiring system operating at any desired voltage and frequency is present and extends throughout the structure that provides the basis for easy connection of the system 10, as described in greater detail hereinafter.

A control panel 12 is plugged into a first duplex outlet 14. The control panel 12 includes a display 16 to indicate its status.

The display 16 can be used to provide any amount of information that is desired. For example, on a simple, low-cost version of the system 10, the display 16 could be an LED to indicate that power is on and that the system 10 is operating normally.

Conversely, on a more elaborate version of the system, the display 16 can be used to provide detailed information such as the status of any or all sensors and other component parts that are connected thereto. As described in greater detail hereinafter, that information can include the specific "address" of each device, its operational status, whether it has battery backup capability, and the like.

The control panel 12 also includes a plurality of panel switches 18, as desired, to control its various operations. If desired, the panel switches 18 can include keys (such as a built-in keypad) to enter a security code to turn the system 10 on or off.

The first duplex outlet 14 supplies 60 cycle 120 VAC electrical power to the control panel 12. A branch electrical circuit 20 supplies electrical power to the first duplex outlet 14 and also, as shown, to a second duplex outlet 22, a third duplex outlet 24, and a fourth duplex outlet 26. The branch electrical circuit 20 may also supply electrical power to other outlets (not shown) and to other electrical devices and appliances (not shown) as well.

The branch circuit 20 receives its electrical power from a distribution box 28, also often referred to in the industry as either a circuit breaker box or a distribution panel. The distribution box 28 receives its electrical power from connection to the electrical supply company (not shown).

The branch circuit 20 is normally concealed in a wall and it represents one of many circuits that are common throughout a structure. It does not matter if all of the duplex outlets 14, 22, 24, 26 are supplied by the same branch circuit 20 as long as they are commonly connected at the distribution box 28.

This normally means that any branch circuit (not shown) to which a component of the system 10 is attached must share a common point of connection. Normally, this is automatically accomplished when they are on the same phase of electrical power.

In residential and commercial installations, approximately 240 VAC power is often available and it consists of two phases of approximately 120 VAC power. All components of the system 10 must be the same phase, else the signals that are transmitted, as discussed in greater detail hereinafter, cannot be conveyed from one component to another component.

Normally, this does not present a problem. If two necessary branch circuits to which component parts of the system 10 are to be connected are not on the same phase, the location of one or more circuit breakers (not shown) can be changed at the distribution box 28 in order to ensure that all component parts of the system 10 share a common phase. A licensed electrician can readily accomplish any wiring modifications, if necessary. Normally, this is not required as most distribution boxes 28 often arrange a sufficient quantity of the duplex outlets 14, 22, 24, 26 so that they are on the same phase. Many of the distribution boxes 28 only have one phase and therefore, this again is not an issue for many installations of the system 10.

A first sensor 30 is plugged into the third duplex outlet 24, as shown. The first sensor 30, in this example, is a motion detector. It can be disposed proximate a window (not shown) or it can be arranged so as to look down a hallway (not shown) or to view a door (not shown).

Figure 2:
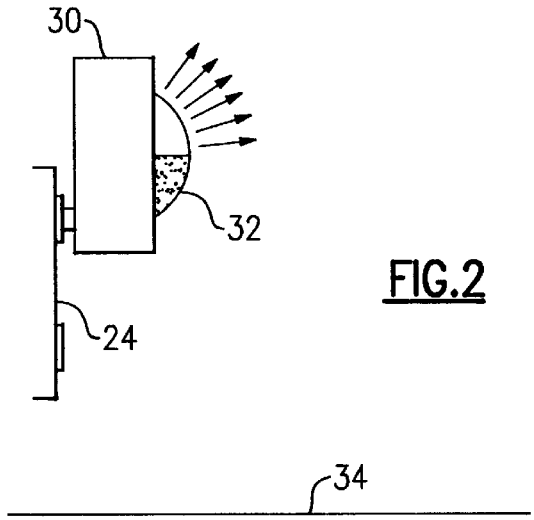
FIG. 2 is a side view of a portion of a first sensor of the modular alarm system.

Referring momentarily to FIG. 2, the first sensor 30 includes a modified motion sensor lens 32 that does not detect motion intermediate the height of the lens 32 and a floor 34. This first sensor 30, in this example, will not detect a pet walking on the floor 34 that is lower in height than the lens 32. This is useful in preventing false alarms from sounding when pets move.

It also illustrates that the first sensor 30, or any other device connected to the system 10, may be any type of an alarm system component that is designed for use with the system 10. The particular component that is selected, for example, as the first sensor 30 may be any type of a device that is desired.

For the system 10 to function, at least one (i.e., the first sensor 30) is required. Otherwise, there would be no indication of a problem or useful information supplied by the system 10. The first sensor 30 can be any type of a sensing device, for example, depending on the application.

It can project a beam of light across a room to a mirror, for example, and detect interruptions in the reflected beam. It can be connected to a pressure mat or any other type of an intrusion detecting device as is well known in the arts. It can include a proximity switch, such as the type used on doors. The proximity switch may be either of the "normally open" or "normally closed" circuit type.

Similarly, the first sensor 30 can be a glass breakage detection device. Any known security device can be modified for use with the system 10.

If desired, the first sensor 30 can detect fire or smoke or any other condition, as desired. It can be a radio receiver and detect a transmitted signal, such as that which would occur if a user pressed a remote "panic" button that they were wearing.

Additional sensors (not shown) are added, as desired. It is normally expected that many sensors will be used to monitor the many likely points of entry into the structure. It is also expected that additional sensors will be added to the system 10 when expansion is desired and that certain of the sensors will be removed when circumstances change and their use is no longer needed.

The method by which additional sensors are added and removed, as well as the manner by which the system 10 is initially installed at a location, are discussed in greater detail hereinafter.

A signaling device 36 is plugged into the second duplex outlet 22. The signaling device 36 includes a bell 38 that can either be directly attached to the signaling device 36 or it may, as shown, include a cable 40 to permit a more remote location for the bell 38.

A second sensor 42 is connected to the fourth duplex outlet 26. The second sensor 42 may include any type of a security device. It may also include a second cable 44 leading to a remote device 46. The remote device 46 may include any type of a sensor that is located distally with respect to the fourth duplex outlet 26. This is advantageous for better placement of the sensing means as it does not have to be disposed near the fourth duplex outlet 26.

The remote device 46, as shown, includes a keypad 48. As such the keypad 48 may be attached to a wall and located near a front entrance door, for example. The keypad 48 is used to enter a code. The code is used to turn the system 10 on or off, as is well known in the alarm arts.

A third cable 50 connects the control panel to a modular telephone jack 52. The modular telephone jack 52 provides a telephone linkage 54 (shown in a dashed line) to a remote monitoring site 56, also sometimes referred to as a "central station" in the industry.

Figure 3:
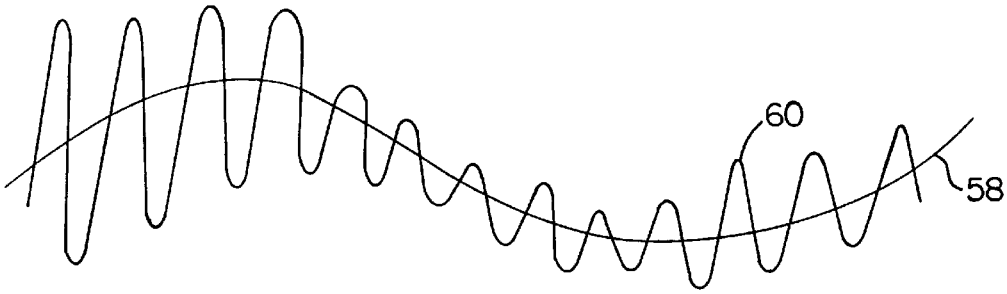
FIG. 3 is a representation of a 60 cycle 120 volt AC wave and a carrier waveform modulated thereto.

Referring now also to FIG. 3, a 120 volt 60 cycle wave 58 is shown, typical of that found on the branch circuit 20 and having 120 VAC. A higher frequency carrier waveform 60 is modulated onto the 60 cycle wave 58. The carrier waveform 60 contains digitally encoded information, as is well known in the electrical arts and is described in greater detail hereinafter.

Upon detection of a variety of possible conditions any component part of the system 10 that is connected to any one of the duplex outlets 14, 22, 24, 26 may initiate a digital transmission of information by the carrier waveform 60 so as to communicate with any other component part of the system 10.

Upon detection of certain conditions, the control panel 12 may also initiate a communication via the modular telephone jack 52 and the telephone linkage 54 to the remote monitoring site 56 or, conversely, the remote monitoring site 56 may initiate communication to the control panel 12 via the telephone linkage 54 and the modular telephone jack 52.

Figure 4:
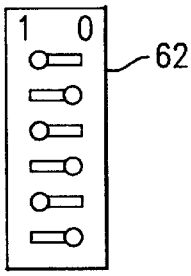
FIG. 4 is a block diagrammatic view of a dip switch, as had by each component of the modular alarm system that connects directly to the 60 cycle 120 VAC line.

Referring to FIG. 4, a dip switch 62 that contains a plurality of switches is shown. Additional dip switches (not shown) are included with every component that connects to any of the duplex outlets 14, 22, 24, 26.

The dip switch 62 is set to represent a digital address for each component of the system 10. The digital address of the dip switch 62, as shown, is binary "101010". As is well known in the electrical arts, additional switch settings may be included in the dip switch 62 to allow for greater binary addresses and therefore additional components of the system 10.

The address of the additional dip switches for each component of the system 10 are set to any address that is desired providing that each one is unique.

For purposes of illustration, assume that the dip switch 62 represents the address of the control panel 12. It may be desirable to standardize the address of the control panel 12 to facilitate recognition by the various components of the system 10, and also by the remote monitoring site 56. In other words, if one standard digital address is normally assigned to the control panel 12, then it becomes a relatively simple matter to program each component part of the system 10 to recognize that particular address.

This is useful in giving priority to messages that are transmitted by the control panel 12 (i.e., a digital transmission of information by the carrier waveform 60 originating at the control panel 12).

Figure 5:
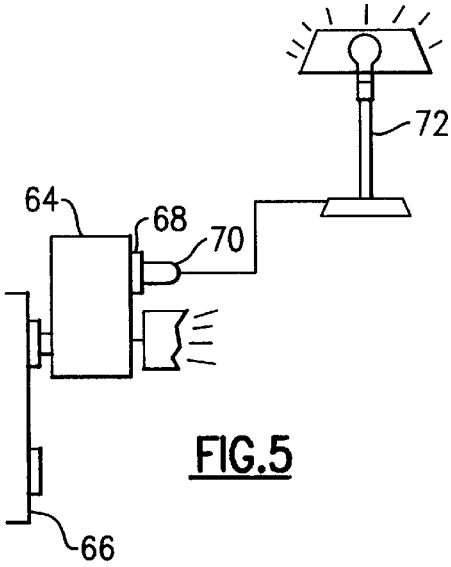
FIG. 5 is a block diagrammatic view of another sensor (a third type of a sensor) useful to turn a lamp on and off.

Referring now also to FIG. 5, a third sensor 64 is shown attached to a fifth duplex receptacle 66, that is assumed to also be connected to the branch circuit 20 or alternatively, to the same phase at the distribution box 28.

The third sensor 64 includes a 120 VAC controlled output 68 to which a line cord 70 is attached. The line cord 70 supplies power to a lamp 72. A second motion sensor 74 that is attached to the third sensor 64 detects the presence of a person (not shown) and supplies power to illuminate the lamp 72.

This is useful if it is desirable to turn on the lamp 72 when the person walks down a dark hallway, such as at nighttime. A timer in the third sensor 64 will turn the lamp 72 off after a predetermined period of time, such as a few minutes.

If desired, the third sensor 64 is configured to inform the system 10 of the detection and activation of the lamp 72 as well. This condition could be supplied as well to the remote monitoring site 56.

Absent any detection of a possible intrusion by the first sensor 30, the detection by the third sensor 64 and illumination of the lamp 72 would not be considered a breach of security. Rather, the condition would be expected such as when the user wakes and passes down the hallway to use a bathroom.

In this example, it is desirable to turn on the lamp 72 but not to conclude that an unauthorized entry has occurred.

Therefore, this example illustrates use of the system 10 to turn on convenience devices, such as the lamp 72, and also to combine the data obtained from the third sensor 64 with that obtained by the first sensor 30 (or other sensors) to better determine whether or not a breach in security has occurred. This is a level of sophistication provided by the most advanced security systems and it shows that by adding the third sensor 64 to the system 10, as comprehensive a system as is desired can be configured.

Not only can additional security types of sensors be added to the system 10, it can also be expanded to perform other convenience or monitoring functions as well. For example, additional devices can be connected to the system 10 to provide all manner of useful information or to control various items in the structure.

Figure 6:
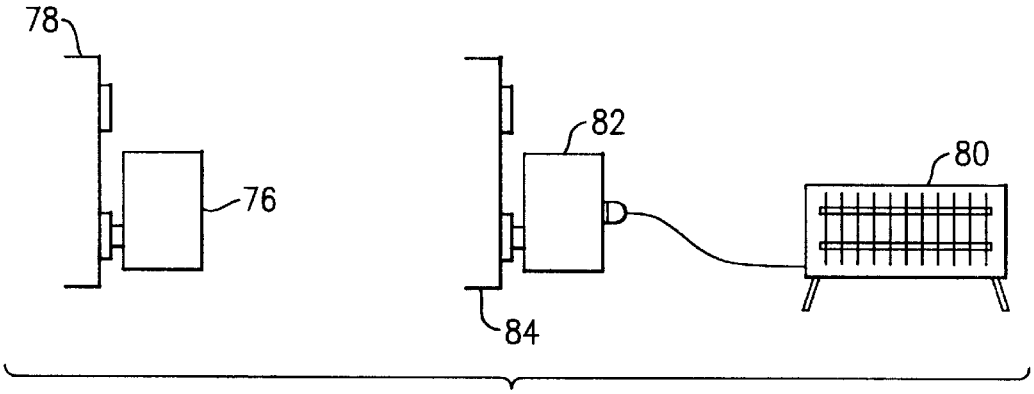
FIG. 6 is block diagrammatic view of a temperature sensing module and a heater control module and heater that are operatively attached to the system.

Referring to FIG. 6, a temperature sensing module 76 can be added to the system 10 to monitor the ambient temperature. The temperature sensing module 76 is attached to a sixth duplex outlet 78. The sixth duplex outlet 78 is connected to the branch circuit 20, as well.

Accordingly, the user can dial up the appropriate telephone number to access the control panel 12 (via a telephone) and upon its answering, the user can enter a password (by pressing the keys on the telephone) to identify himself (as having authority) and thereby to gain access to any of the information that is accessible by the control panel 12, in much the same way as could the remote monitoring site 56 also obtain this, and other information.

In this example, the user would enter a second "code" specifically to request the ambient temperature. The control panel 12 would initiate communication by modulating a digital transmission of information via the carrier waveform 60 over the branch circuit 20. That particular transmission would identify the address (via the dip switch) of the temperature sensing module 76 and would poll it.

The temperature sensing module 76, following the established communication protocol, would in turn provide that information (by modulating a digital transmission of information via the carrier waveform 60 over the branch circuit 20) to the control panel 12 which would in turn provide that information to the user over the telephone.

For a more deluxe version of the system 10, the control panel 12 would announce the temperature, such as "70 degrees". This would assure the user that the heating system at a ski cabin, for example, is operating properly.

Obviously, the user could enter other "codes" and obtain other information, such as a status check of the system 10 generally. If desired, the system 10 could be used to turn on a heater 80 by the user if a heater control module 82 were attached to a seventh duplex outlet 84. In this instance, the heater control module 82 would also be assigned its own unique "dip" address.

The user could then command the control panel 12 (via the telephone) to turn on the heater 80 that is controlled by the heater control module 82, should he deem the temperature to be too low in the ski cabin, as a result of the information provided by the temperature sensing module 76. Or he might turn on the heater 80 via a cellular telephone call he could make prior to his arrival at the ski cabin so as to ensure his comfort upon arriving.

Of course, it is a significant advantage of the system 10 to be able to add the temperature sensing module 76 and the heater control module 82 later if the system 10 is moved from an office to the ski cabin, for example, or if it is simply desired to expand the system 10 and offer this increased capability.

Similarly, the system 10 can be used to turn on lights, make coffee, even to turn on a crock pot (not shown) depending solely upon the devices that are connected to the system 10 and the wishes and intentions of the user.

Referring again to FIG. 1, a first battery 86 (shown in dashed lines) is attached to the first sensor 30. A second battery 88 is similarly attached to the control panel 12. A third battery 90 is attached to the signaling device 36. The capacity of the first, second, and third batteries 86, 88, 90 are selected to provide battery backup for whatever time period is desired, in the event of the loss of AC power. The loss of AC power can occur for any number of reasons, including a deliberate sabotage attempt.

It is intended that any of the component parts of the system 10 be designed so as to accept the battery (86, 88, 90) by merely plugging it into the sensor or component part.

All of the component parts of the system 10 are "smart" devices. They must all have a microprocessor and operating system. They must all be able to recognize their own address (from their own dip switches) and to respond to communications directing their presence. They must also be able to transmit of their own information as is relevant.

For example, if the first sensor 30 detects an unauthorized entry, it must communicate this condition to the control panel 12 via a digital transmission that is encoded over the branch circuit 20. Obviously, the control panel 12 must be able to detect this transmission, receive it, decode its meaning, and respond appropriately.

One appropriate response might be for the control panel 12 to communicate with the signaling device 36 and sound the bell 38. The bell 38 can be a siren or any other type of a device having an auditory output.

Another appropriate response, either alone or in combination with that as mentioned above, would be for the control panel 12 to communicate (by dialing) the remote monitoring site 56 and informing it of the situation. Police, in this example, could then be sent. The fire department, depending upon the nature of the condition detected and reported, could instead be sent. Obviously, the owner himself could be called by the control panel 12, if desired.

Figure 7:
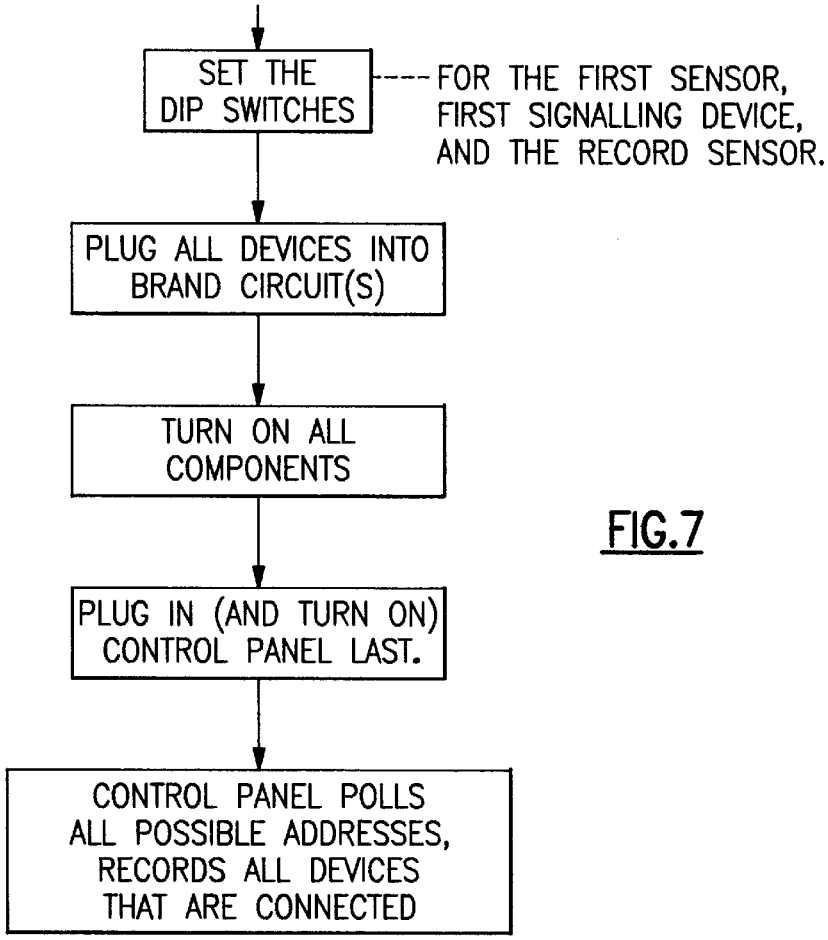
FIG. 7 is a flowchart of the installation process.

The system 10 is designed to be easy to install. It is modular and can be expanded. The installation procedure is illustrated by the following discussion and by reference to the flowchart of FIG. 7.

The person who performs the installation may be either the user (presumably the owner of the system 10) or it may be personnel supplied by the company selling the system 10. For purposes of illustration, we will assume the components of FIG. 1 are being installed.

Initially, an installer (not shown) would set the dip switches of all devices to their own unique addresses. He would then plug them all into the various duplex outlets 14, 22–26, supplying power lastly to the control panel 12.

The control panel 12 would then poll every possible dip switch address, one at a time, so as to determine what devices are present. Each device would respond, one at a time, over the branch circuit 20 with a digitally encoded transmission that identifies its presence and the type of a device it is when it detects its unique address. Failure to respond by any device to a particular address is indication that no device having that address is attached to the system 10.

If a backup battery is connected to any of the devices, that would also be reported to the control panel 12. The status of the device would also be reported.

In this manner the control panel 12 determines all devices with which it is in communication. As such the system 10 automatically determines all devices that are connected to it. This information is shown on the display 16 and is scrolled (i.e., selected for presentation) by the panel switches 18.

The installer is therefore able to verify that all devices believed to be connected are, in fact, connected to the system 10. Installation is easy and can be accomplished quickly by relatively unskilled personnel as there is no house wiring required other than connection of the various sensors to the duplex outlets and of the control panel 12 to the telephone jack 52.

If another device is to be connected to the system 10 (to enhance its capabilities), the new device is given a unique dip switch address and plugged into the branch circuit 20. The control panel 12 is then reset, either by powering it down and up again, or by appropriate command of the panel switches 18. The control panel 12 again polls all of the possible dip switch settings (i.e., the device addresses), finds all of them including the newly added device.

Similarly, if a particular device were to be removed from the system 10, the process would be repeated after the device that is to be removed has been unplugged. The system 10 would reconfigure itself automatically.

As such, the system 10 provides the modular alarm system 10 which is easy to install and upgrade or modify, as desired. Because little or no wiring is required, the system 10 is especially useful in apartments and offices.

Also, as the data is digital, personal computers (not shown) and personal electronic organizers (not shown) can be interfaced with and used to obtain information from the system 10 as well.

The various sensors and devices are normally quiet. That is they do not transmit digitally encoded data on the branch circuit unless they detect a condition that warrants doing so.

Figure 8:
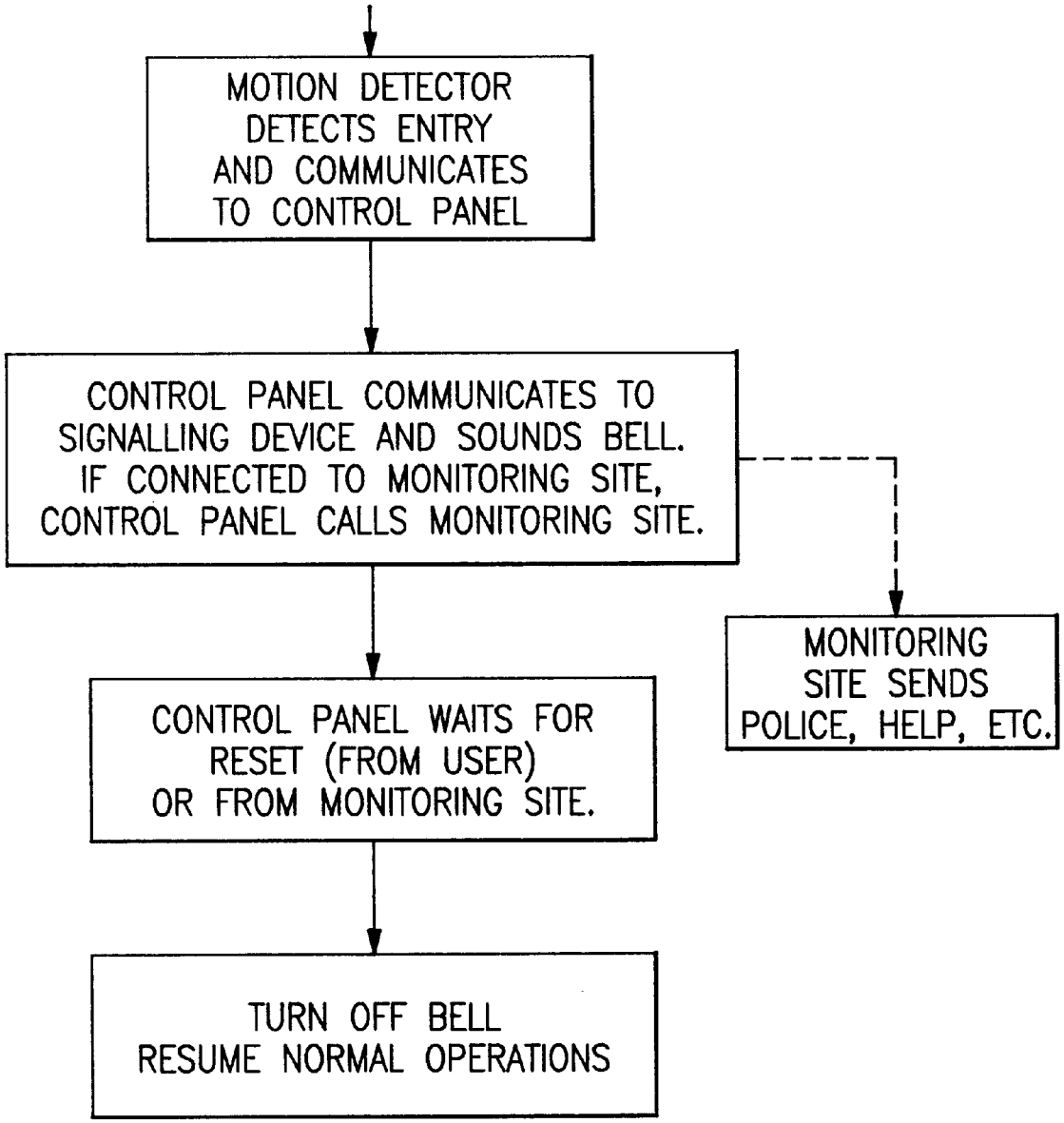
FIG. 8 is a flowchart of a detection of an emergency condition that requires a response.

For example, referring also to the flowchart of FIG. 8, if the first sensor 30 detects a break-in, it would immediately transmit this condition on the branch circuit, outputting in particular the address "101010" which is that of the control panel 12. The control panel 12 would decode this condition, and presumably, communicate to the signaling device 36, telling it to sound the bell 38. It would also simultaneously communicate to the monitoring site 56, if it is connected to the telephone jack 52, and it would digitally apprise the monitoring site 56 that a break-in is occurring.

Personnel at the monitoring site would summon help, as needed, and after correcting the problem the monitoring site 56 would output a digital signal to reset the control panel, thereby turning off the bell 38. Alternatively, the keypad 48 could be used to turn off the bell 38 by the user. Normal operation of the system 10 is then resumed.

The control panel 12 is programmed so as to have in memory the telephone number of the monitoring site 56 by the installer. If desired, it is also programmed with a unique digital code to permit the monitoring site 56 to determine which control panel is having the alarm condition arise so that personnel at the monitoring site 56 can take appropriate action, such as sending police to the location.

The unique digital code is either set by the installer or it can be downloaded by the monitoring site 56. If service by the monitoring site 56 is obtained, the monitoring site is given the telephone number by which access to the control panel 12 can be obtained.

The monitoring site 56 can, as an optional way of configuring the system 10, place a telephone call to the control panel 12 (upon subscription to the monitoring site 56). The monitoring site can then transmit via the telephone link 54 a special code so as to configure, or to reconfigure, the system 10. The monitoring site 56 can extend the communication by providing the control panel 12 with the unique digital code (as mentioned hereinabove) so that it can identify the control panel 12 should it receive a call therefrom.

Accordingly, the monitoring site 56 can also learn the identity and status of all devices that are connected to the system 10. This information can be periodically polled by the monitoring site 56 as part of the security service provided. Being digital data, it can be recorded by the monitoring site 56. This is useful for determining status of the system 10 over time and especially just prior to an event, such as an unauthorized entry.

Of course, one of the many possible enhancement type of devices that can be built and added to the system is a recorder (not shown) that is disposed at the residence or office where the system 10 is located and which is periodically updated as to the status of all of the component parts of the system.10 by the control panel 12.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A modular alarm system apparatus, comprising:

(a) a control panel, said control panel electrically connected to a source of alternating electrical power and having a unique address;

(b) a first sensor electrically connected to said source of electrical power, said first sensor having a unique address that is different than that of said control panel; and (c) means for providing bi-directional communication over said source of alternating electrical power between said first sensor and said control panel;

whereby upon installation of said system, said control panel outputs every possible address other than its own on power-up including said unique address of said first sensor to determine that said first sensor is electrically connected to said source of alternating electrical power, and wherein said control panel monitors said source of alternating electrical power for communication indicating a change in status by said first sensor.

2. The system of claim 1 including a plurality of sensors, each of said sensors having a unique address and being connected to said source of alternating electrical power.

3. The system of claim 1 wherein said first sensor is a motion detector.

4. The system of claim 1 wherein said first sensor includes a keypad.

5. The system of claim 1 including at least one device operatively attached to said system, said device adapted to control a device disposed in a structure containing said system.

6. The system of claim 1 including means for receiving a telephone communication.

7. The system of claim 6 wherein said means for receiving a telephone communication includes connection to a remote monitoring facility that is adapted to communicate to said system.

8. The system of claim 6 wherein said means for receiving a telephone communication includes means for controlling a function of said system by an instruction received via said telephone communication.

9. The system of claim 1 including means for originating a telephone communication to a party by said control panel.

10. The system of claim 9 wherein said party includes a remote monitoring facility.

11. A method for installing modular alarm system components, comprising:

(a) setting a unique address to identify each component;

(b) electrically connecting each component to a common phase of the AC power supply including a control panel;

(c) powering up all components, each component normally being quiescent;

(d) powering up the control panel lastly;

(e) outputting by the control panel every possible unique address other than its own address;

(f) each component responding to only its unique address by outputting a reply;

(g) noting the presence of each component at each particular unique address by the control panel.

12. The method of claim 1 wherein said step of outputting by the control panel every possible unique address other than its own address includes the step of outputting an inquiry as to the status of any device having that unique address.

13. The method of claim 12 wherein said step of setting a unique address to identify each component includes setting at least one dip switch on each component to represent said unique address.

* * * * *